US008128209B2

(12) United States Patent
He

(10) Patent No.: US 8,128,209 B2
(45) Date of Patent: Mar. 6, 2012

(54) INK CARTRIDGE FOR INKJET PRINTER

(75) Inventor: Yonggang He, Zhuhai (CN)

(73) Assignee: Print-Rite•Unicorn Image Products Co., Ltd. of Zhuhai, Guangdong (CN)

( * ) Notice: Subject to any disclaimer, the term of this patent is extended or adjusted under 35 U.S.C. 154(b) by 1077 days.

(21) Appl. No.: 11/989,394

(22) PCT Filed: Jul. 11, 2006

(86) PCT No.: PCT/CN2006/001645

§ 371 (c)(1),
(2), (4) Date: Jan. 25, 2008

(87) PCT Pub. No.: WO2007/012255

PCT Pub. Date: Feb. 1, 2007

(65) Prior Publication Data

US 2010/0149292 A1 Jun. 17, 2010

(30) Foreign Application Priority Data

Jul. 25, 2005 (CN) ..... 2005 2 0062070 U

(51) Int. Cl.
*B41J 2/175* (2006.01)
*B41J 2/195* (2006.01)

(52) U.S. Cl. ..... 347/85; 347/7; 347/86

(58) Field of Classification Search ..... 347/7, 85, 347/86

See application file for complete search history.

(56) References Cited

U.S. PATENT DOCUMENTS

| | | | |
|---|---|---|---|
| 6,502,933 | B2 | 1/2003 | Lim et al. |
| 2003/0122907 | A1 | 7/2003 | Kim |

FOREIGN PATENT DOCUMENTS

| | | |
|---|---|---|
| CN | 1334198 | 2/2002 |
| CN | 2544940 | 4/2003 |
| CN | 1188284 | 2/2005 |
| CN | 1603113 | 4/2005 |
| CN | 2691854 | 4/2005 |
| CN | 2759782 | 2/2006 |
| EP | 1366908 | 12/2003 |
| JP | 9-220817 | 8/1997 |
| JP | 10-119297 | 5/1998 |

*Primary Examiner* — Matthew Luu
*Assistant Examiner* — Jannelle M Lebron
(74) *Attorney, Agent, or Firm* — Venable LLP; Michael A. Sartori; Steven J. Schwarz

(57) ABSTRACT

An ink cartridge includes a main body and a cover. A liquid storing chamber and an air introducing post for communicating the liquid storing chamber with the outside atmosphere are disposed in the main body. A liquid filling port is disposed on the cover. A balancing chamber, a detecting chamber, and a floater are disposed in the main body. The balancing chamber and the detecting chamber are in communication with each other via a through hole. The detecting chamber and the liquid storing chamber are in communication with each other via a liquid guiding port. The floater, whose density is lower than that of the ink liquid, is located in the detecting chamber. The lower portion of the air introducing post communicates with the outside atmosphere via a waterproof sponge. The ink cartridge may conveniently monitor usage of ink liquid in the main body and reduce residual ink.

5 Claims, 4 Drawing Sheets

INK CARTRIDGE FOR INKJET PRINTER

CROSS-REFERENCE TO RELATED APPLICATIONS

The present application is the U.S. National Stage of International Application No. PCT/CN2006/001645, filed Jul. 11, 2006, which claims the priority benefit of Chinese Application No. 200520062070.6, filed on Jul. 25, 2005. The entire content of both of the foregoing applications is expressly incorporated herein by reference.

FIELD OF THE INVENTION

The present invention relates generally to the consumer printer field, and more specifically, relates to an ink cartridge for an inkjet printer.

BACKGROUND OF THE INVENTION

In general, an inkjet printer is equipped with an ink cartridge for connecting with its print head. The inkjet printer must be capable of continuously and uniformly supplying ink during its printing process. The ink cartridges generally use the capillary force of a porous body, such as a sponge, to store ink liquid and control the ink supply. For example, Chinese patent publication No. 1334198A discloses an ink cartridge with a spillover dam board. The ink cartridge includes a housing enclosing a wick chamber. The housing includes a top wall and an ink chamber. A fluid conduit connects the ink chamber and the wick chamber. The outer surface of the top wall of the housing is formed with a recess. A vent opening through the top wall of the wick chamber, at the recess, provides fluid communication between the wick chamber and the recess. A covering over the top surface of the housing encloses the recess. An outlet opening through an outer wall other than the top wall of the wick chamber provides fluid communication for the ink to flow from the wick chamber. One end of an overflow tube is in fluid communication with the recess in the top wall of the housing. The other end of the overflow tube opens to the ambient environment at another point on the exterior of the housing, such as near the outlet opening. A dam in the recess, between the vent opening and the one end of the overflow tube, impedes, but does not completely obstruct, the flow of spillover ink from the vent opening into the overflow tube. Generally, with this type of ink cartridge, it is hard to prevent residual ink from remaining therein. In addition, its production cost is high, and it is not easy to keep a state of constant negative pressure in the ink cartridge.

Further, an improved ink cartridge can be obtained as a result of the improvement of the ink cartridge structure. Such an improved ink cartridge can store ink liquid and control the ink supply merely by its geometric structure. For example, Chinese utility model patent No. 02227387.5 discloses an ink cartridge which can cause its whole inner chamber to be in a state of negative pressure, and which can further ensure that the ink outlet is in a sealing state to prevent ink from leaking out when the ink cartridge has been detached from a printer. The ink cartridge includes an ink storing chamber, a pressure regulating mechanism, a sealing member, and a spring. The pressure regulating mechanism is located in the ink storing chamber and includes a front valve body, a rear valve body, a valve membrane, a cover and a spring. The front valve body and the rear valve body closely connect with each other and form a space, with the valve membrane disposed there between. The spring is between the valve membrane and the front valve body. The rear valve body is formed with an air groove, a concave hole is formed on a protrusion which is on the centre of the bottom surface of the air groove. The valve membrane is provided with a small circular hole which has a protruding rim, and which is pressed in the concave hole of the rear valve body by the spring. The pressure regulating mechanism is mounted on the cover of the ink storing chamber. The cover has a vent opening communicating the atmosphere with the air hole formed on the air groove of the rear valve body. The technical solution makes use of the sealing function acting on both the vent opening and the ink outlet by the pressure regulating mechanism to adjust the negative pressure which arises after the print needle has absorbed ink, such that the ink storing chamber is in the negative state when the ink cartridge is working. The spring force in combination with a sealing ball can cause the ink outlet to be sealed after the ink cartridge is detached from a printer. In order to realize that the ink storing chamber is in the negative pressure state when the ink cartridge is working, and the ink outlet is sealed after the ink cartridge is detached from a printer, the technical solution needs to add a pressure regulating mechanism. Accordingly, the technical solution complicates the structure, and further complicates manufacturing technology.

Furthermore, there is known an ink cartridge with another structure without a sponge. Chinese patent application No. 20041008321.3 discloses an ink cartridge comprising an ink tank for storing ink and a shutter mechanism arranged in the ink tank. The shutter mechanism includes a lever which can swing and which has one end provided with a shutter and the other end provided with a float. The weight and the volume of the float are set so that the first direction, in which the lever moves by the buoyancy and the gravity generated when the entire shutter mechanism is positioned in the ink, is opposite to the second direction, in which the lever moves by the buoyancy and the gravity when a part of the float protrudes from the ink liquid surface. A residual amount of the ink is indicated without being excessively affected by any disturbance such as the surface tension of the ink.

SUMMARY OF THE INVENTION

According to an embodiment of the present invention, an ink cartridge for an inkjet printer can be real monitored in real time for the level of ink in the ink storing chamber, and can also provide an air transport function to maintain the air pressure balance in the ink cartridge.

According to the above-mentioned object, an ink cartridge for inkjet printer comprising a main body and a cover is provided. A liquid storing chamber for storing ink and an air introducing post for communicating the liquid storing chamber with the outside atmosphere are disposed in the main body. The cover is used to cover the main body. The ink cartridge includes a liquid filling port for filling ink disposed on the cover. Furthermore, a balancing chamber, a detecting chamber and a floater are disposed in the main body. The balancing chamber communicates with the detecting chamber via a through hole, and communicates with the liquid storing chamber at its bottom in the vertical direction. The detecting chamber and the liquid storing chamber are in communication with each other via a liquid guiding port. The floater, whose density is lower than that of ink liquid in the liquid storing chamber, is located in the detecting chamber. The lower portion of the air introducing post in the vertical direction communicates with the outside atmosphere via a waterproof sponge.

The following further improvements of the above-mentioned technical solution can provide an ink cartridge having a better effect.

The position of the above-mentioned through hole can be adjusted so that it is located on the upper portion of both the balancing chamber and the detecting chamber in the vertical direction.

When the position of the liquid guiding port is lower than the bottom of the balancing chamber in the vertical direction, the balancing chamber can better maintain the internal pressure balance of the ink cartridge.

According to a preferred embodiment, the waterproof sponge can be plugged and filled in an air guiding chamber whose position is lower than the bottom of the liquid storing chamber in the vertical direction, and whose upper portion in the vertical direction communicates with the outside atmosphere via an air groove going through the bottom wall of the main body.

The cover can be provided with a protruding portion. In a state in which the main body and the cover have been assembled together, the protruding portion can be located on the outside of the top of the main body in the vertical direction. The part of the cover that corresponds to the position of the protruding portion concaves toward the protruding portion to form a recess.

Figure 1:
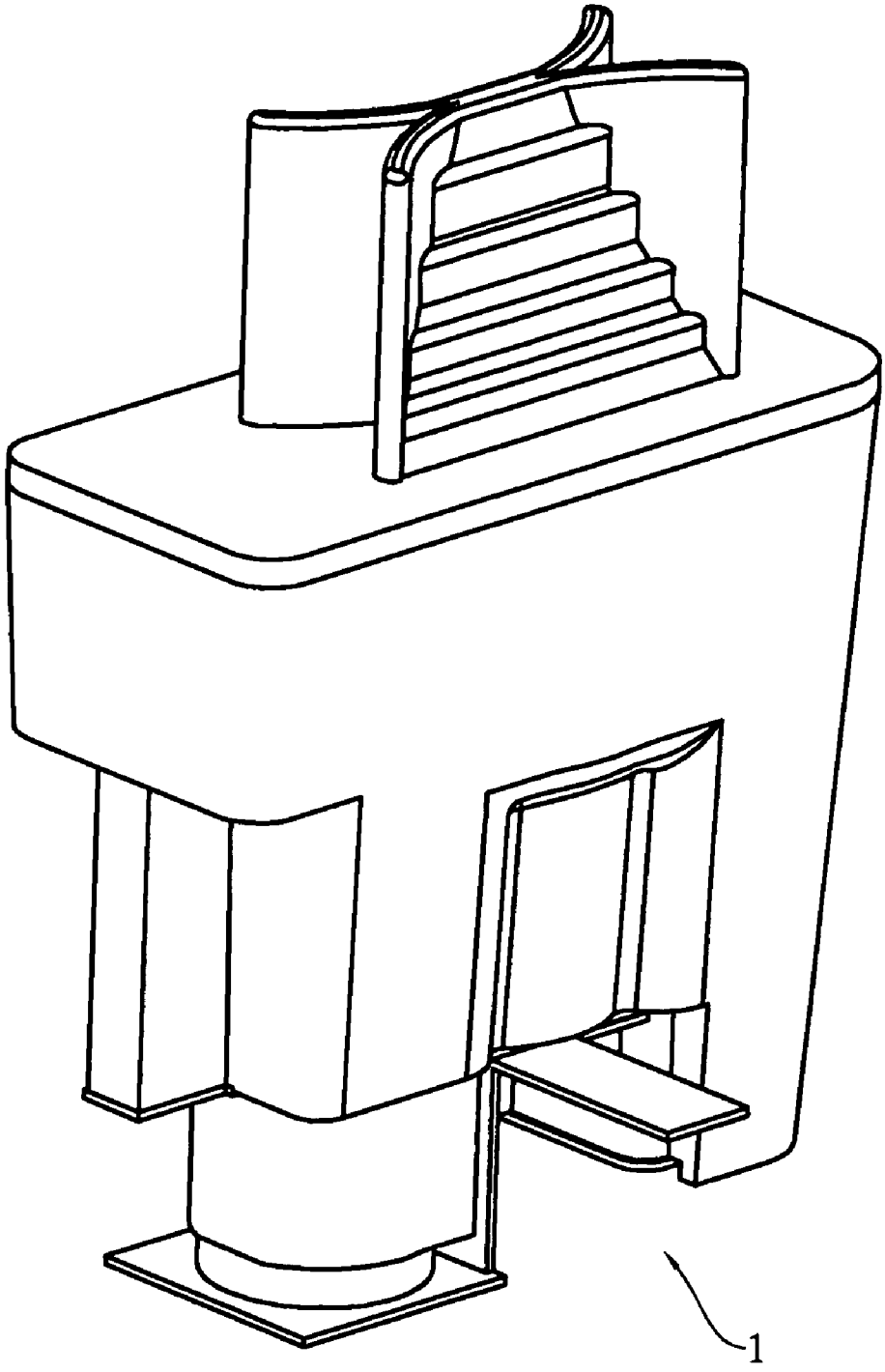
FIG. 1 is a perspective view showing the ink cartridge for inkjet printer of an embodiment of the present invention.

Hereinafter, the present invention will be further described in detail in combination with the drawings and the depicted embodiments.

DETAILED DESCRIPTION OF THE INVENTION

FIGS. 1-7 show an embodiment of the ink cartridge for inkjet printer according the present invention. When referring to the description and drawings of the present invention, directions are based on a state in which an ink cartridge 1 has been mounted on a printer, namely based on the disposition state of the ink cartridge shown in FIG. 7.

The ink cartridge 1 comprises a main body 3 and a cover 2.

The main body 3 is provided with a liquid storing chamber 30 for storing ink, an air introducing post 34 used for communicating the liquid storing chamber 30 with the outside atmosphere, an ink supply port 32 going through the bottom wall of the main body 3 for supplying ink to a printer, a balancing chamber 313 for regulating the pressure in the liquid chamber, a detecting chamber 315 for monitoring the ink storing amount in the liquid storing chamber, and a floater 316 in the detecting chamber 315. The lower portion of the ink supply port 32 is designed as a cylindrical chamber 321. A sealing member 322 mated with the ink supply needle of a printer is disposed in the vicinity of the lower end surface of the cylindrical chamber 321. Generally, a heat sealing membrane 323 is used to seal the lower end surface of the cylindrical chamber 321 after ink has been filled (FIG. 5 and FIG. 7).

Figure 4:
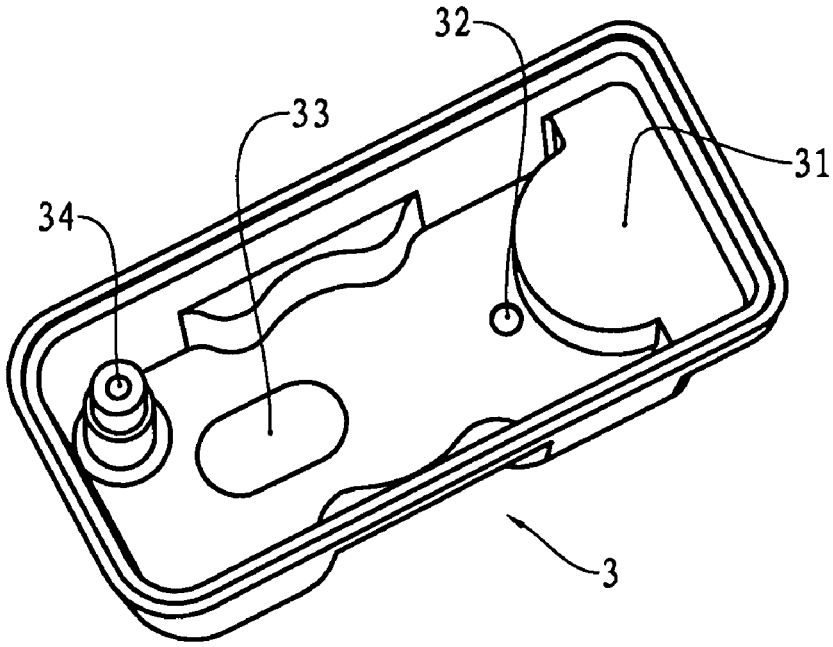
FIG. 4 is a perspective view showing the main body of the ink cartridge for inkjet printer of an embodiment of the present invention.
Figure 5:
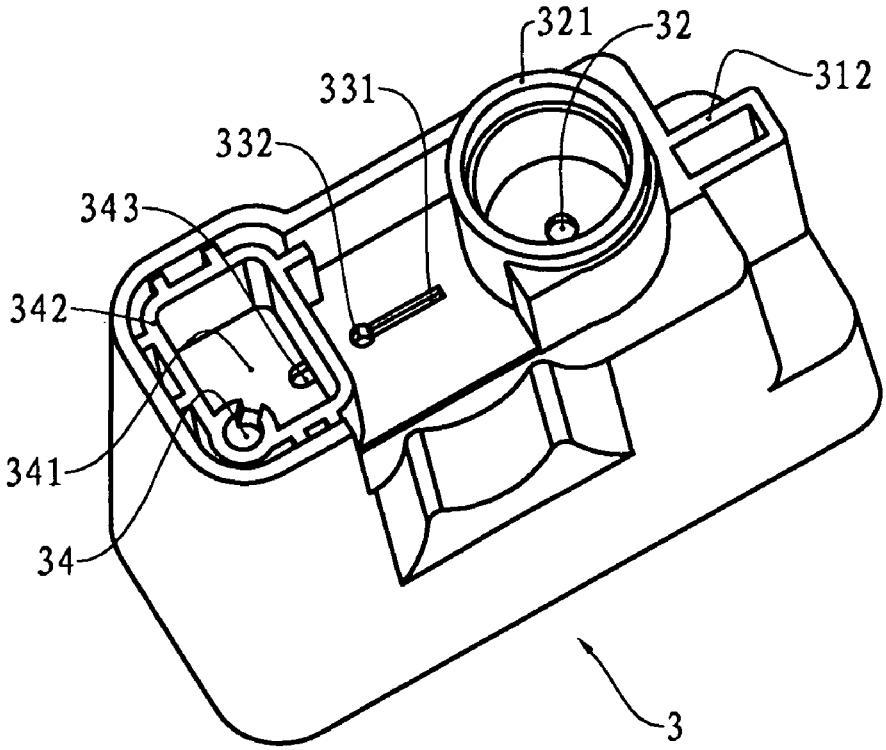
FIG. 5 is another perspective view showing the main body of the ink cartridge for inkjet printer of an embodiment of the present invention.
Figure 6:
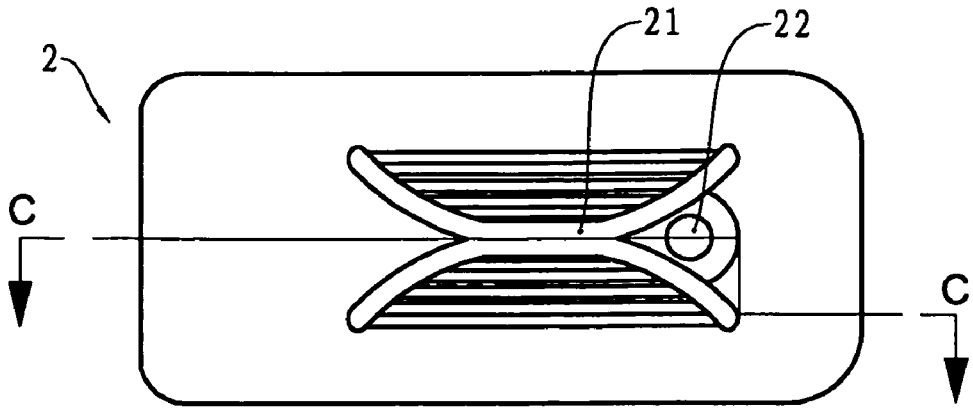
FIG. 6 is a top view showing the cover of the ink cartridge for inkjet printer of an embodiment of the present invention.
Figure 7:
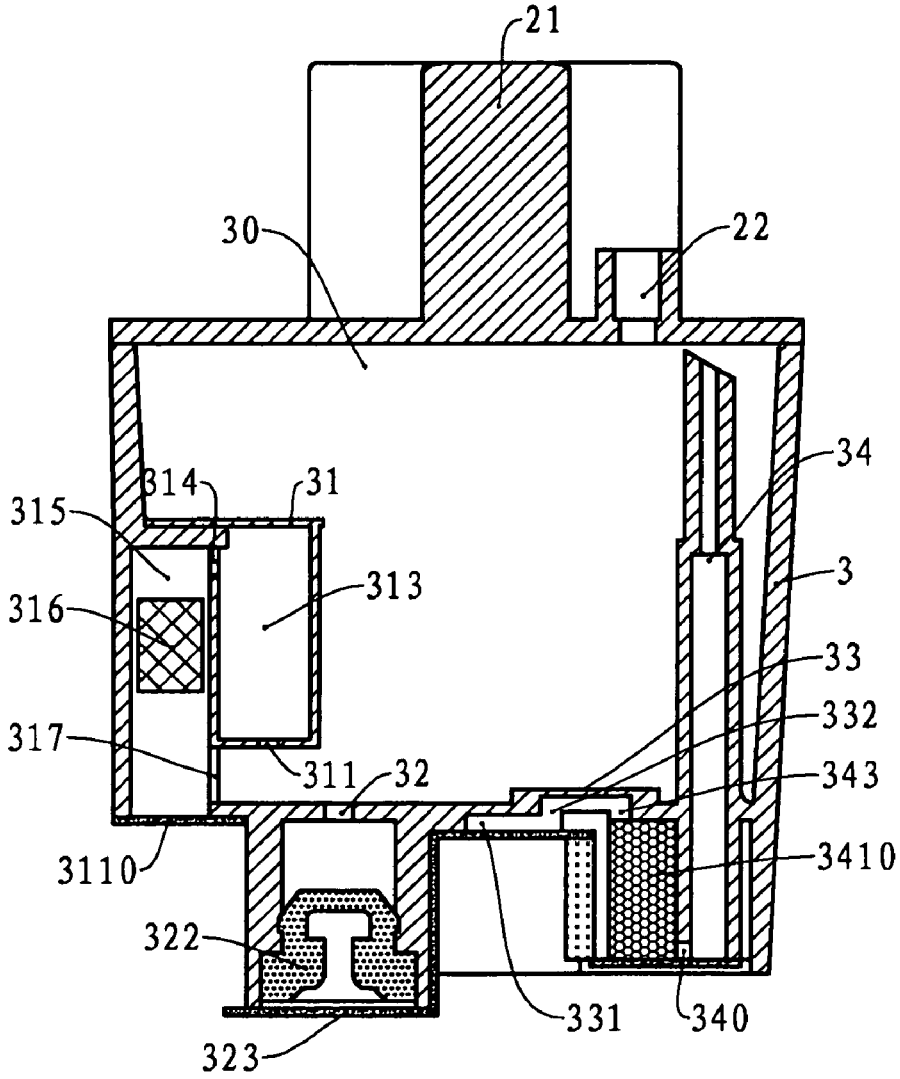
FIG. 7 is a cross-sectional view taken along line C-C of FIG. 6, showing the ink cartridge for inkjet printer of an embodiment of the present invention.

Referring to FIG. 4, FIG. 5 and FIG. 7, the balancing chamber 313 and the detecting chamber 315 are disposed on the lower portion of a platform 31 which is near the side wall of the main body 3. The balancing chamber 313 communicates with the detecting chamber 315 via a through hole 314, and communicates with the liquid storing chamber 30 via a through hole 311 at its bottom in the vertical direction. The through hole 314 is located near the top portion of both the balancing chamber 313 and the detecting chamber 315. The detecting chamber 315 and the liquid storing chamber 30 are in communication with each other via a liquid guiding port 317 whose position is lower than the bottom of the balancing chamber 313, and whose lowest end and the bottom of the liquid storing chamber 30 are substantially on the same level. A floater 316 is located in the detecting chamber 315. In order to ensure the floater 316 can float on the ink liquid surface, the density of the floater 316 should be lower than that of the ink in the liquid storing chamber 30, and the contact area between the floater 316 and the liquid surface should be an appropriate value. Generally, for convenience in installation, an opening is first formed at the bottom 312 of the detecting chamber 315, and then the floater 316 is put into the detecting chamber 315, and last the opening is hermetically closed by a membrane 3110. The wall of the main body 3 where the detecting chamber 315 is disposed is made of transparent or light transparent material for convenient monitoring. Accordingly, the condition of the ink liquid in the ink cartridge may be conveniently monitored by naked eyes or by using an optical sensor. The ink cartridge is designed so that the ink in the liquid storing chamber 30 is consumed first. The floater 316 stays near the top of detecting chamber 315 until the ink in the liquid storing chamber 30 is consumed to the upper end of the through hole 311 or to the upper end of the liquid guiding port 317, namely, until air enters the balancing chamber 313. Therefore, the ink contained in the liquid storing chamber 30 is furthest used to reduce the amount of residual ink.

The bottom of the air introducing post 34 is lower in position than the bottom of the liquid storing chamber 30. The upper end of the air introducing post 34 is higher than the liquid surface of the ink stored in the liquid storing chamber 30, and is in air communication with the liquid storing chamber 30. An air guiding chamber 341 is provided on the bottom of the air introducing post 34. The air guiding chamber consists of a part of the side walls 342 of the main body 3 and is located lower in position than the bottom of liquid storing chamber 30. The lower portion of the air guiding chamber 341 is open and communicates with air introducing post 34. The upper portion of the air guiding chamber 341 communicates with the outside atmosphere via an air opening 343, an air groove 332 formed in the bottom wall of the main body 3, and an opening 331 on the bottom wall of the main body 3 in turn. After the waterproof sponge 3410 is plugged into the air guiding chamber 341, the bottom opening of the air guiding chamber 341 is closed by a heat sealing membrane. Before the ink cartridge is put onto a printer for use, the opening 331 is closed by a sealing member which is made of the same material as the heat sealing membrane 323 and which is formed integrally with the heat sealing membrane 323. A thickened protruding platform 33 is formed on the bottom wall of the main body 3 on which the air opening 343, the air groove 332, and the opening 331 are provided by means of partial thickening of the bottom wall to enhance the strength of the relevant portion. When the waterproof sponge 3410 together with the labyrinthic air groove 332 are implemented, it is hard for the ink in the ink cartridge to enter the air guiding chamber 341 and the relevant portion of the air groove 332. Accordingly, it is ensured that there is no ink leaking out from the ink cartridge when the heat sealing membrane is peeled off before the ink cartridge is mounted onto a printer.

Figure 2:
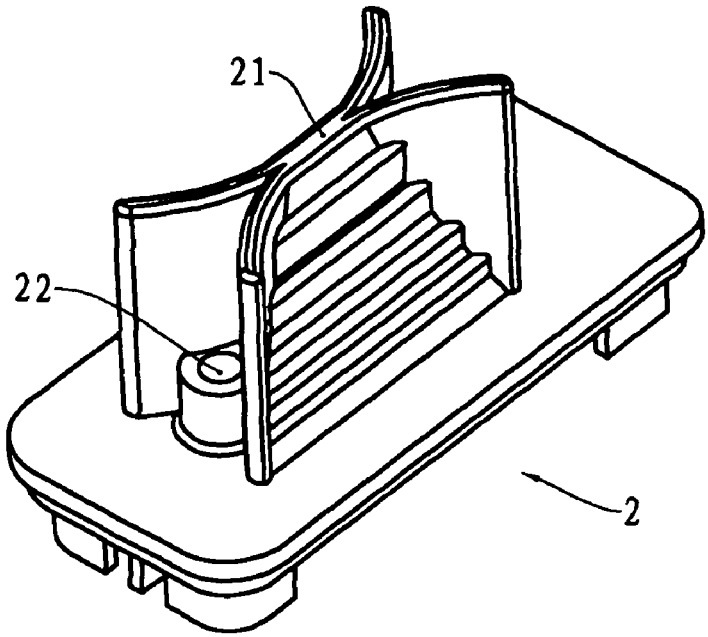
FIG. 2 is a perspective view showing the cover of the ink cartridge for inkjet printer of an embodiment of the present invention.
Figure 3:
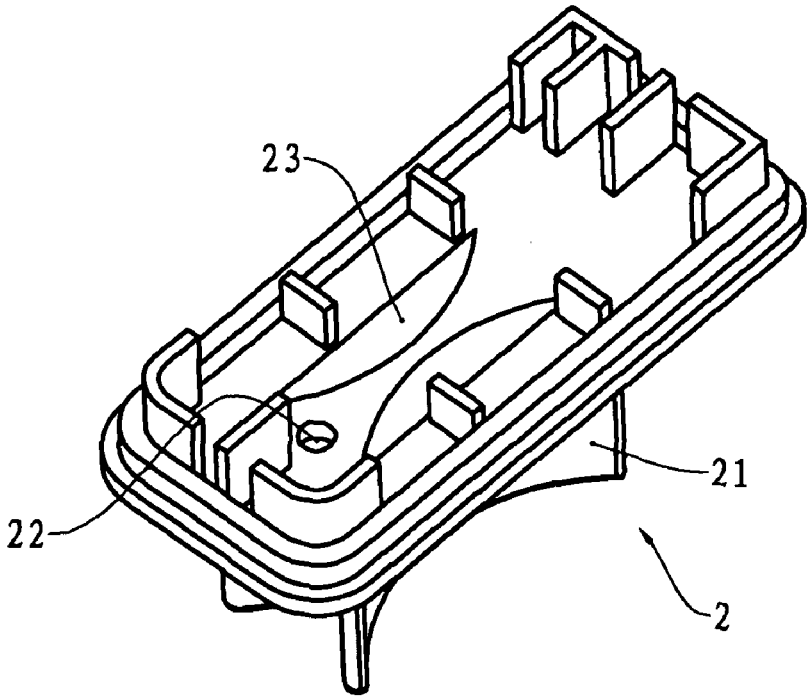
FIG. 3 is another perspective view showing the cover of the ink cartridge for inkjet printer of an embodiment of the present invention.

Referring to FIG. 2, FIG. 3 and FIG. 7, the cover 2 is used for covering the main body 3. A protruding portion 21 and a liquid filling port 22 for filling ink are provided on the cover 2. In a state in which the main body 3 and the cover 2 have been assembled together, the protruding portion 21 is located on the outer side of the top of the main body 3. The part of the cover 2 corresponding to the position of the protruding portion 21 concaves to the protruding portion 21 and forms a recess 23 which is helpful to regulate the pressure state in the ink cartridge.

Before being put onto an inkjet printer for use, the ink cartridge for inkjet printer of the present invention is first filled with ink from the liquid filling port 22 in a negative pressure environment, and then the liquid filling port 22 is sealed by a plastic plug in the negative pressure state, so the inner chamber of the ink cartridge maintains the negative pressure state.

In order to ensure that the detecting chamber 315 is completely full of ink and has no air, the ink cartridge for inkjet printer of the present invention should stand slantwise on its side for seconds before it is mounted onto a printer for use. As a result, the floater 316 is in the top of the detecting chamber 315 in the vertical direction to sufficiently perform its indication function. That the ink cartridge stands slantwise on its side means the state in which the bottom of the detecting chamber 315 is in the lower position and the top of the detecting chamber 315 is in the upper position with respect to the vertical direction. When the ink cartridge restores the normal disposition state in which the ink cartridge is working, the floater 316 rises and floats to the top of the detecting chamber 315 in the vertical direction. When the ink cartridge is in the normal operating state, the top of the detecting chamber 315 in the vertical direction is set as the region for observation by eyes or for detection by an optical sensor, to monitor the amount of ink in the ink cartridge.

Application to Industry

The ink cartridge for inkjet printer of the present invention includes three chambers having respective functions: the liquid storing chamber, the balancing chamber, and the detecting chamber. A floater for indicating the amount of stored ink is disposed in the detecting chamber. On the ink supply balance side, a waterproof sponge having multiple apertures and having a strong buffer and regulating function is implemented. Because of the pressure regulating function of the balancing chamber, and the buffer and regulating function of the waterproof sponge, the floater can sink or float as the ink storing amount in the liquid storing chamber changes. Further, changes in the amount of ink stored in the liquid storing chamber can be monitored by naked eyes, or by an optical sensor, so the amount of the residual ink is reduced.

What is claimed:

1. An ink cartridge for inkjet printer comprising:

a main body and a cover used for covering said main body;

a liquid storing chamber for storing ink and an air introducing post communicating said liquid storing chamber with the outside atmosphere;

wherein further a balancing chamber, a detecting chamber and a floater are disposed in the main body, the balancing chamber and the detecting chamber are communicated via a through hole, said through hole is located on the upper portion of both said balancing chamber and said detecting chamber in the vertical direction;

said balancing chamber communicates with said liquid storing chamber at its bottom in the vertical direction, said detecting chamber and said liquid storing chamber communicate with each other via a liquid guiding hole;

said floater having a density that is lower than that of the ink in said liquid storing chamber, wherein said floater is located in said detecting chamber.

2. The ink cartridge for inkjet printer according to claim 1, wherein:

a liquid filling port for filling ink is disposed on said cover; and the lower portion of said air introducing post in the vertical direction communicates with the outside atmosphere via a waterproof sponge.

3. The ink cartridge for inkjet printer according to claim 1, wherein:

the position of said liquid guiding hole is lower than the bottom of said balancing chamber in the vertical direction.

4. The ink cartridge for inkjet printer according to claim 3, wherein:

said waterproof sponge is plugged in an air guiding chamber which position is lower than the bottom of said liquid storing chamber in the vertical direction, and which upper portion in the vertical direction communicates with the atmosphere outside via an air groove going through the bottom wall of said main body.

5. The ink cartridge for inkjet printer according to claim 4, wherein:

said cover is provided with a protruding portion, in a state in which said main body and said cover have been assembled together, said protruding portion is out of the top of said main body in the vertical direction, the part of said cover corresponding to the position of said protruding portion concaves to said protruding portion and forms a recess.

* * * * *